United States Patent [19]

Smith et al.

[11] 3,981,272

[45] Sept. 21, 1976

[54] MAG BRUSH HOUSING WITH DETACHABLE SUMP SECTION

[75] Inventors: Richard E. Smith, Webster; Augustus W. Griswold, Rush, both of N.Y.

[73] Assignee: Xerox Corporation, Stamford, Conn.

[22] Filed: Nov. 20, 1974

[21] Appl. No.: 525,528

[52] U.S. Cl. ..... 118/637; 355/3 DD; 427/18

[51] Int. Cl.[2] ..... G03G 13/09

[58] Field of Search ..... 355/3 DD; 118/637; 222/DIG. 1; 427/18

[56] References Cited

UNITED STATES PATENTS 3,337,072 8/1967 Del Vecchio et al. ..... 118/637 X 3,927,640 12/1975 Smith ..... 118/637

*Primary Examiner*—Joseph F. Peters, Jr.
*Assistant Examiner*—James LaBarre

[57] ABSTRACT

A magnetic brush development system for developing latent electrostatic images carried by a photoconductively coated substrate has a split housing comprising a movable section with a sump for storing a supply of developer, a stationary section including one or more development rolls which are fed with developer from the sump to carry out the development process, a latching mechanism for releasably securing the movable section of the housing to the stationary section, and a flow gate which is interlocked with the latching mechanism so that the flow gate is closed to interrupt the flow of developer from the sump whenever the latch is released.

12 Claims, 6 Drawing Figures

MAG BRUSH HOUSING WITH DETACHABLE SUMP SECTION

BACKGROUND OF THE INVENTION

This invention relates to development systems for electrostatic processors and, more particularly, to housings for those systems.

In a conventional electrostatic printing process of the type described in Carlson's U.S. Pat. No. 2,297,691 on "Electrophotography", a uniformly charged photoconductor is selectively discharged in an image configuration to provide a latent electrostatic image which is then developed through the application of a finely divided marking material, called "toner". As is known, that process has enjoyed outstanding commercial success, especially in plain paper copiers and duplicators. Nevertheless, substantial effort and expense are still being devoted to the perfection of the process, including the development step.

The modern practice is to carry out the development step on the fly — viz., as the photoconductor moves through a development zone. There are various ways to accomplish that, but magnetic brush development has recently come into favor because it is capable of providing superior solid area coverage while satisfying the normal requirement for minimal background development.

Characteristically, a magnetic brush development system includes one or more development rolls which are rotated in a shaped magnetic field to brush the image bearing photoconductor with a multi-component developer containing toner particles and larger, ferromagnetic "carrier" particles. The toner and carrier (or, sometimes, carrier coating) components of the developer are formed from materials which are separated from one another in the triboelectric series, with the result that electrical charges of opposite polarities tend to be imparted to the two different types of particles by a triboelectric charging process. Moreover, consideration is given to the triboelectric ranking of the materials selected so that there is a tendency for the toner particles to acquire a charge having a polarity opposing the polarity of the latent image.

In operation, developer is magnetically entrained on the development roll or rolls. The magnetic field is shaped so that the developer carried by those rolls tends to collimate as it is advanced through the development zone, thereby forming bristle-like stacks of developer which brush against the image bearing photoconductor. There are, of course, competing electrostatic forces acting on the toner particles, whereby those particles at least initially tend to be attracted to the carrier particles, but are subject to being electrostatically stripped therefrom when they are moved into the immediate proximity of or actual contact with the photoconductor.

As will be appreciated, the quality of the copies produced through the use of a magnetic brush development process are dependent on the spacing of the development roll or rolls from the photoconductor. Generally, an electrical field is established between those rolls and a supporting substrate for the photoconductor to suppress background development. Thus, any change in the development roll-to-photoconductor spacing not only alters the quantity of toner deposited on the image, but also varies the gradient of the field. It goes without saying that changes in either of those two parameters are necessarily accompanied by a corresponding change in the quality of the copies produced.

Unfortunately, it has not been practical with prior magnetic brush development systems to do anything more than approximate the optimum development roll-to-photoreceptor spacing. As a general rule, those systems can be serviced only after they have been moved, development rolls and all, away from the photoconductor. Accordingly, no particular effort has been made to maintain a constant development roll-to-photoreceptor spacing since precise repositioning of a development roll is a time consumming task at best.

SUMMARY OF THE INVENTION

Accordingly, an object of this invention is to provide a split housing for magnetic brush development systems so that such a system may be internally accessed for maintenance purposes and the like, without upsetting the development roll-to-photoreceptor spacing.

A somewhat more detailed object of the present invention is to provide an interlocked latch and flow gate for a housing of the foregoing type so that the housing may be split to internally access the development system, without risk of inadvertantly spilling developer from the sump. A specific related object is to provide a flow gate which not only serves as failsafe protection against developer being spilled from the sump when the housing is split, but which also may be used in purging the development roll or rolls of developer.

To carry out these and other objects of the invention, a magnetic brush development system has a housing containing a stationary section for the development roll or rolls and a movable section for the sump. The two sections are releasably latched to one another by a latching mechanism which is interlocked with a flow gate so that the flow gate is opened and closed as the latch is engaged and disengaged, respectively. The flow of developer through the discharge opening of the sump is interrupted whenever the flow gate is closed. Hence, there is failsafe protection against spilling developer from the sump when the two sections of the housing are separated to internally access the development system. The development roll or rolls may be purged of developer simply by disengaging the latch to close the flow gate and thereafter operating the development system for a short period of time.

BRIEF DESCRIPTION OF THE DRAWINGS

Still further objects and advantages of this invention will become apparent when the following detailed description is read in conjunction with the attached drawings in which.

DETAILED DESCRIPTION OF THE ILLUSTRATED EMBODIMENT

While the invention is described in some detail hereinafter with reference to a single illustrated embodiment, it is to be understood that there is no intent to limit it to that embodiment. On the contrary, the aim is to cover all modifications, alternatives and equivalents falling within the spirit and scope of the appended claims.

Figure 1:
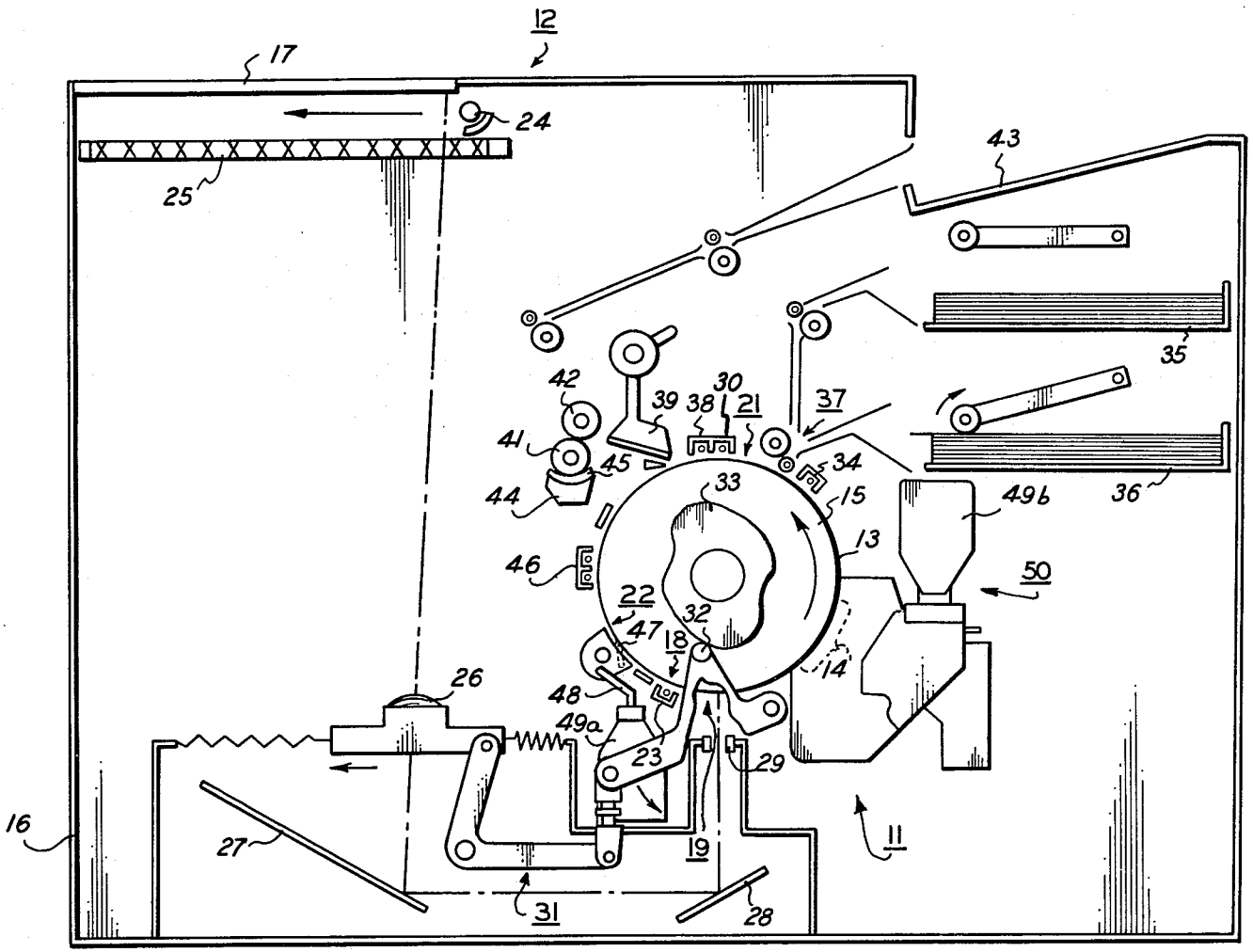
FIG. 1 is a simplified schematic diagram of an electrostatic processor having a magnetic brush development system with a split housing constructed in accordance with the present invention.

Turning now to the drawings, and at this point especially to FIG. 1, it will be seen that the invention is embodied in a development system 11 which is used in an electrostatic processor 12 to develop latent electrostatic images carried by a photoconductor 13 on the fly — viz., as the photoconductor 13 moves through a development zone 14. In this instance, the photoconductor 13 is coated on the surface of a rotatable drum 15. It will be apparent, however, that there are other suitable machine configurations, including one wherein a flexible photoconductor is supported by a belt-like substrate.

There is no reason to dwell at length on the processor 12. It is simply an exemplary environment for the invention, and it closely resembles a commercially available "4000" copier of Xerox Corporation as modified to include the new development system 11. Thus, anyone interested in the specific details of that copier can inspect one of the commercially available units and refer to the published literature describing it, such as U.S. Pat. No. 3,724,019, which issued Apr. 3, 1973 in the name of Alan L. Shanly. Nevertheless, a brief functional description may be helpful.

Considering the processor 12 on that level, it will be observed that the drum 15 and its related components are enclosed within a base frame 16 which has a transparent platen 17 for supporting a document or other object (i.e., subject copy) image side down in position to be copied. The drum 15 is rotatably driven in the direction of the arrow (counterclockwise as shown) so that the photoconductor 13 is sequentially advanced during each copying cycle through a charging station 18, an exposure station 19, the development zone 14, a transfer station 21, and a cleaning station 22.

At the outset of each copying cycle, the photoconductor 13 is uniformly charged by a corona generator 23 as it advances through the charging station 18 and then selectively discharged in response to light reflected from the subject copy as it moves through the exposure station 19. There is, therefore, a latent electrostatic image of the subject copy on the photoconductor 13 when it reaches the development zone 14.

To carry out the exposure step, this particular copier comprises a scanning lamp 24 which is driven from one side to the other of the platen 17 during each copying cycle by a double helix auger drive 25 to illuminate successive lines or strips of the subject copy from below. The light reflected from the subject copy is intensity modulated in accordance with the image to be copied and is focused on the photoconductor 13 by a movable lens 26, a pair of stationary mirrors 27 and 28, and an exposure slit 29. To maintain the focus, the movable lens 26 is laterally driven in timed synchronism with the scanning lamp 24. That is accomplished by means of a linkage 31 which has a follower 32 riding on a camming surface 33 which, in turn, is mounted for rotation with the drum 15.

As described in detail hereinbelow, the development system 11 applies toner to develop the image carried by the photoconductor 13 as it advances through the development zone 14. The toner charge is than partially neutralized by a pre-transfer corona generator 34, thereby conditioning the toner image for transfer to a copy sheet under the influence of transfer corona generator 30 at the transfer station 21. The copy sheet is selectively fed from one of two supply trays 35 and 36 and is brought into contact with the photoconductor 13 by a sheet feeding and registration mechanism schematically shown at 37.

After the image has been transferred, the drum 15 rotates beneath a detack corona generator 38, which at least partially neutralizes the charge previously provided by the transfer corona generator 30, and then beneath a vacuum-type stripper 39. The stripper 39 removes the copy sheet from the photoreceptor 13 and transports it into a nip between a pair of heated fuser rolls 41 and 42.

The fuser rolls 41 and 42 supply heat and pressure for fixing the toner image to the copy sheet so that the copy which is ultimately fed into the output tray 43 has a substantial degree of permanence. To minimize the tendency for toner to offset during the fusing process, there is a reservoir 44 with a wick 45 for applying a release agent, such as silicone oil, to the lower fuser roll 41, which is the one that engages the image bearing side of the subject copy.

While fusing is taking place, the photoreceptor 13 continues to advance into the cleaning station 22 wherein there is a pre-cleaning corona generator 46 for at least partially neutralizing the charge tending to hold residual toner on the photoconductor 13, followed by a resilient cleaning blade 47 for wiping the residual toner from the photoconductor 13 in preparation for the next copying cycle. Advantageously, the toner removed by the cleaning blade 47 is routed through a tube 48 into a bottle **49*a* which is identical to the toner supply bottle 49*b* used in the toner dispenser 50 of the development system 11. In that event, the residual toner can be reclaimed simply by letting the bottle 49*a* fill and then using it as a replacement for the toner supply bottle 49*b***.

Figure 2:
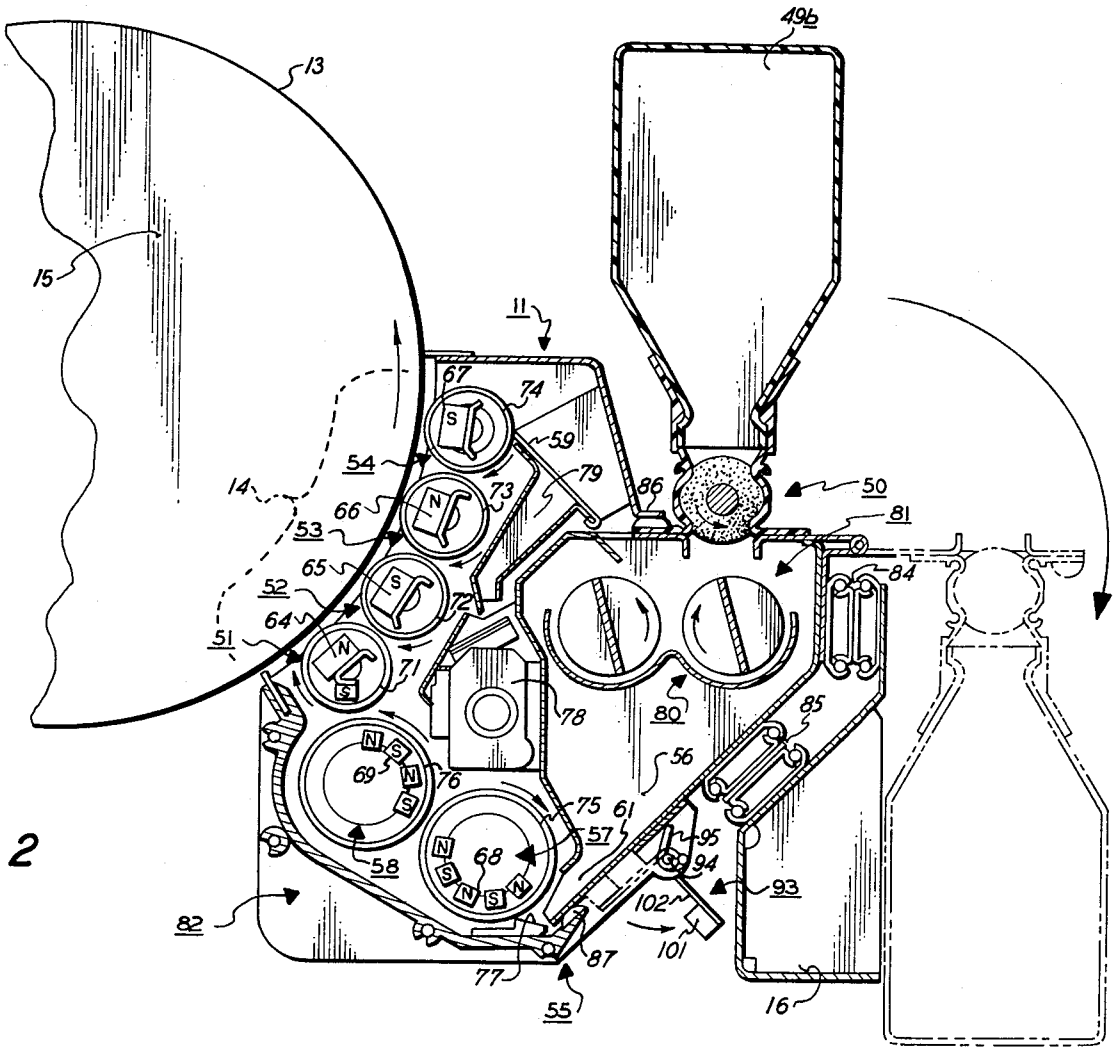
FIG. 2 is an enlarged, sectional veiw illustrating the basic components of the development system shown in FIG. 1.

As shown in FIG. 2, the development system 11 is a so-called "magnetic brush" unit having a series of four development rolls 51–54 for brushing the photoconductor 13 with developer as it advances through the development zone 14. Suitably, the developer is a mixture of finely divided, resinous toner particles and larger, ferromagnetic carrier particles, such as is used in other development systems of this same general type.

In accordance with the present invention, there is a "split" housing 55 for supporting the development rolls 51–54 in parallel spaced apart relationship adjacent the photoconductor 13. The reason that the housing 55 is referred to as being "split" will become evident from what follows. For now, therefore, it suffices to merely note that the housing 55 comprises a sump 56 for storing a supply of developer, a tandem pair of magnetic transport rolls 57 and 58 for transporting developer from the sump 56 to the first or lowermost development roll 51, and a downwardly inclined slide 59 leading away from the last or uppermost development roll 54.

In operation, developer flowing through a discharge opening 61 near the bottom of the sump 56 is transported along a generally S-shaped path by the transport rolls 57, 58 and is then fed upwardly between the photoconductor 13 and successive ones of the development rolls 51–54. The developer within this part of the system is magnetically constrained. Specifically, the development rolls 51–54 and the transport rolls 57, 58 comprise permanent magnet assemblies 64–69, respectively, which are supported within separate non-magnetic, cylinderical sleeves 71–76. The sleeves 71–76 are rotatably driven in the direction indicated by the arrows so that the developer magnetically entrained thereon under the influence of the stationary fields provided by the magnetic assemblies 64–69 advances from roll-to-roll, as previously described.

Characteristically, the fields supplied by the magnetic assemblies 64–67 are shaped so that the developer on the development rolls 51–54 tends to collect in bristle-like stacks while passing between those rolls and the photoconductor 13, thereby causing the aforementioned brushing of the photoconductor 13 with developer. To ensure that the "magnetic brushes" thus formed have a generally uniform profile widthwise of the development zone 14, there suitably is a metering gate 77 for leveling the profile of the developer magnetically entrained on the first transport roll 57.

After passing between the photoconductor 13 and the last development roll 54, the developer is deposited on the slide 59. Some of the developer is then routed into an automatic development control (ADC) unit 78 via a chute 79, but most of it remains on the slide 59 until it reaches a crossmixer 80. As described and claimed in a copending and commonly assigned U.S. patent application of Richard E. Smith, Ser. No. 525,531 for "Active Crossmixer", the crossmixer 80 reconditions the developer for recirculation and then returns it to the sump 56. To aid in the reconditioning process, the toner dispenser 50 is mounted immediately above the crossmixer 80 so that the additional toner that is supplied thereby from time-to-time to maintain the toner concentration of the developer at a suitable high level is thoroughly mixed and blended in with the recirculating developer. Typically, the toner dispenser 50 is automatically actuated (by means not shown) to provide additional toner whenever the ADC unit 78 senses that the toner concentration of the developer is below a predetermined set point level.

Figure 3:
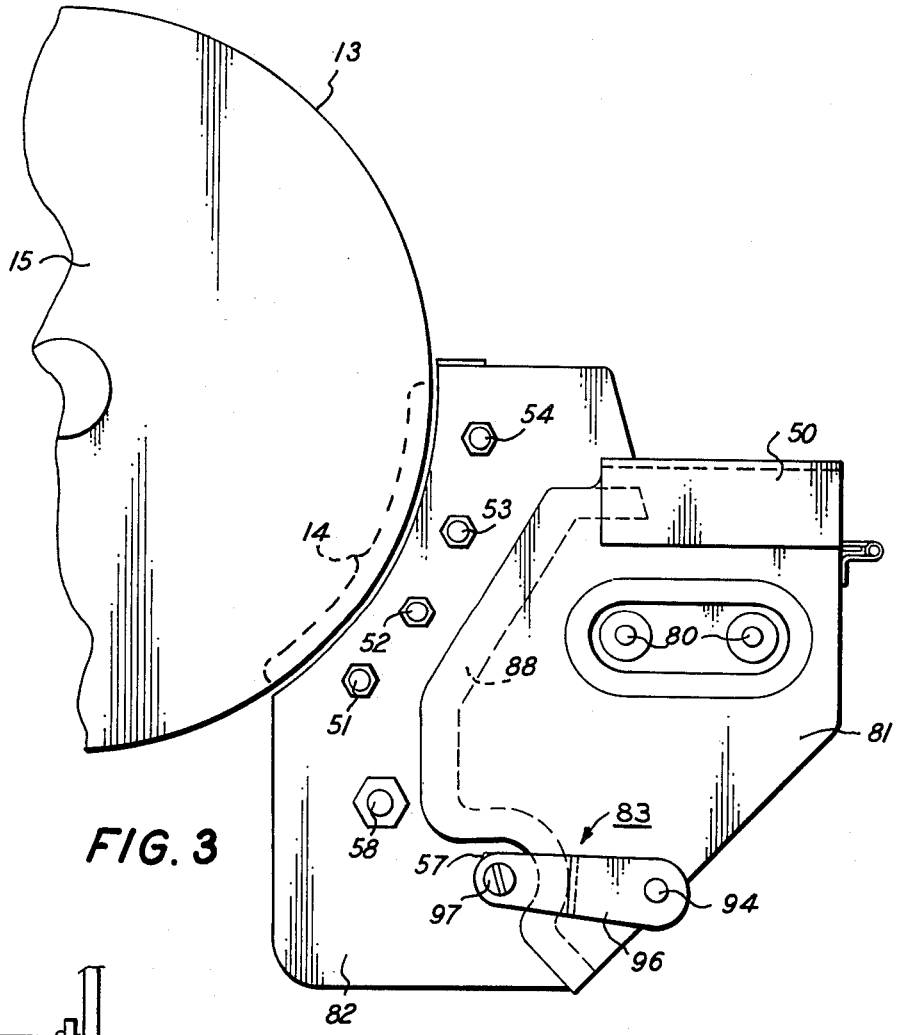
FIG. 3 is a side view of the housing for the development system, with certain parts being omitted in the interest of clarity.
Figure 4:
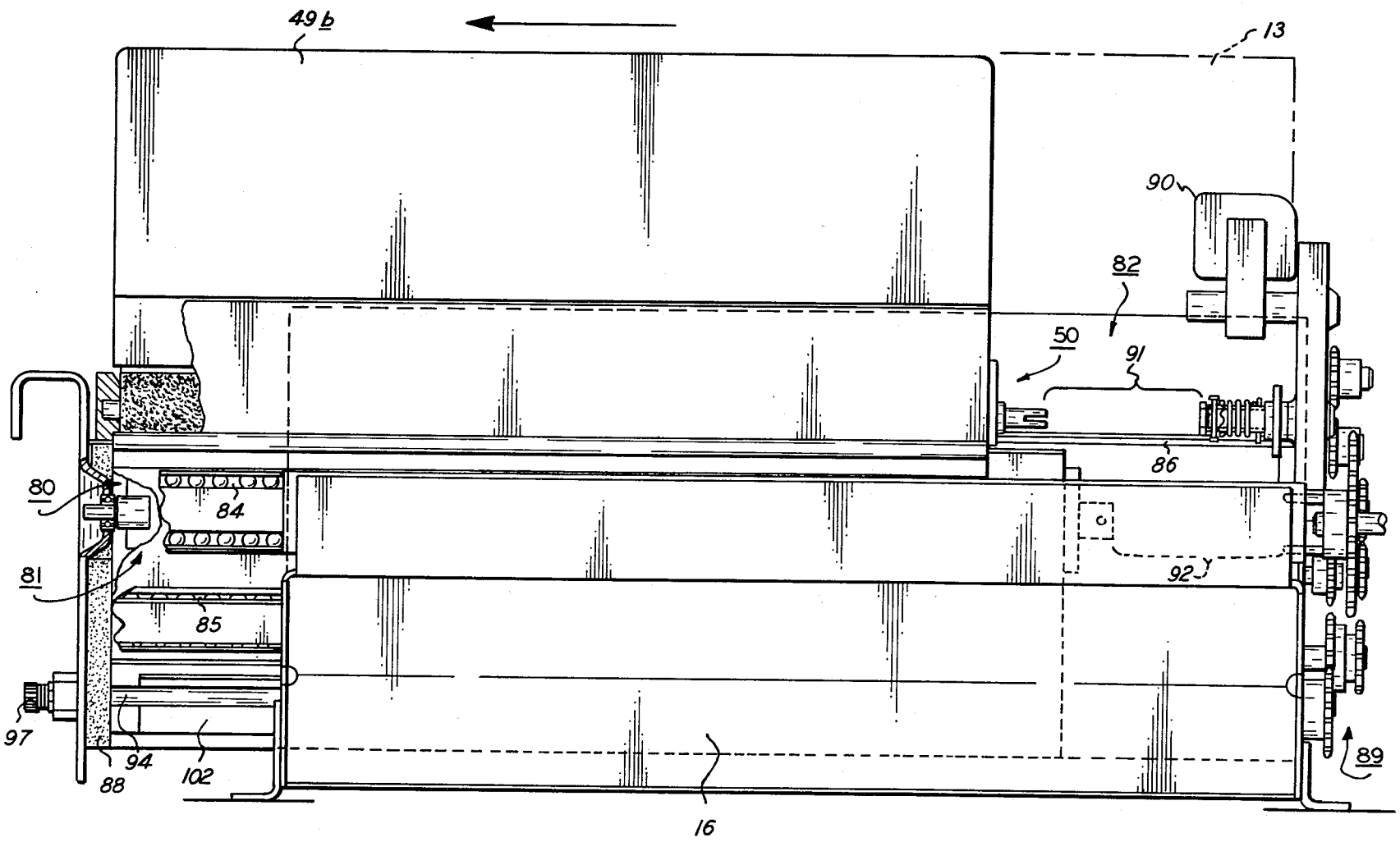
FIG. 4 is a rear view of the housing shown in FIG. 3, as seen when the housing is partially split.

As shown in FIGS. 2–4, in keeping with this invention, the housing 55 is "split" so that the development system 11 may be internally accessed for maintenance purposes and the like, without altering the spacing between the photoconductor 13 and any one of the development rolls 51–54. To this end, the housing 55 comprises a movable section 81 which is releasably secured to a stationary section 82 by a latch mechanism 83. The stationary section 82 houses the development rolls 51–54 and is more or less permanently anchored to the baseframe 16 (by means not shown) in a position immediately adjacent the photoconductor 13. The movable section 81, on the other hand, is mounted on a pair of telescoping guides 84 and 85 for sliding movement along a path running generally parallel to the axes of the development rolls 51–54 (i.e., transversely of the development 14). Hence, most servicing required by the development system 11 may be performed while the development rolls 51–54 remain in place at a predetermined, optimum distance from the photoconductor 13.

The stationary section 82 preferably includes the transport rolls 57 and 58, as well as the development rolls 51–54, so that the housing 55 may be split, without upsetting the transport roll-to-transport roll spacing or the transport roll-to-development roll spacing. Conversely, the sump 56 is ideally located in the movable section 81 so that the developer charge may be readily changed. These considerations generally dictate the distribution of the other components of the development system 11. Specifically, as shown, the stationary section 82 further includes the slide 59 and the chute 79, while the movable section 81 additionally contains the crossmixer 80.

In passing, it is noted that there are gaskets, such as at 86–88, which seal the housing 55 when the movable section 81 is secured to the stationary section 82. Furthermore, as best shown in FIG. 4, separate quick disconnect couplings 91 and 92 are employed to mate the toner dispenser 50 with the drive shaft of a motor 90 and the crossmixer 80 with the main drive 89 for the development system 11. The advantage of using couplings of that type is, of course, that nothing more than the movement of the movable section 81 is required to engage and disengage the drives for the toner dispenser 50 and the crossmixer 80.

Figure 6:
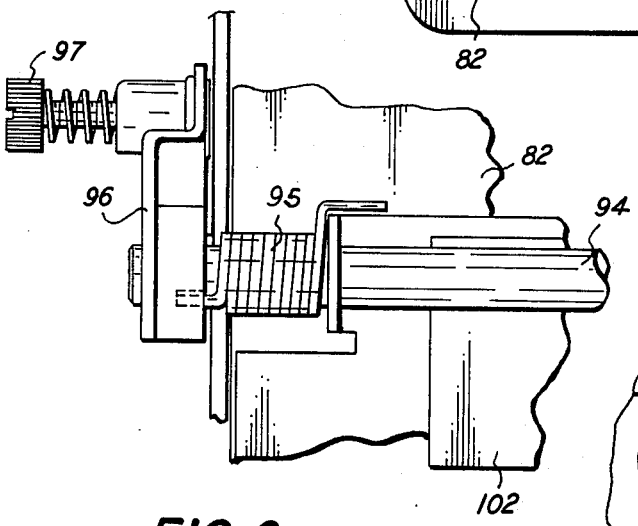
FIGS. 5 and 6 are enlarged, fragmentary views illustrating the interlock provided, in keeping with this invention, between the latching mechanism and flow gate for the housing of FIGS. 3 and 4.
Figure 5:
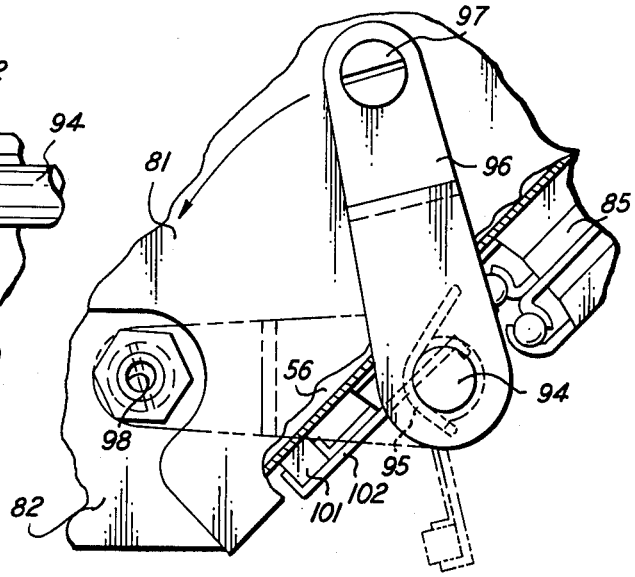

Referring to FIGS. 2, 5, and 6, in accordance with one of the important details of this invention, there is a flow gate 93 which is interlocked with the latching mechanism 83 so that the flow of developer from the sump 56 is automatically interrupted whenever the movable section 81 of the housing 55 is released from the stationary section 82. In this instance, the flow gate 93 is opened and closed as the latching mechanism 83 is engaged and disengaged, respectively. To that end, the latching mechanism 83 and the flow gate 93 are interconnected by a shaft 94 which is journalled for rotation in the movable section 81 of the housing 55 and biased by a torsion spring 95.

More particularly, as shown, the latching mechanism 83 comprises a strapping link 96 which has one end secured to the shaft 94 and its other or free end equipped with a thumb screw 97. There is a bore 98 in the stationary section 82 of the housing 55 for receiving the thumb screw 97 whenever one wants to engage the latch, but the link 96 must be rotated against the bias supplied by the spring 95 to bring the thumb screw 97 into alignment with the bore 98. The flow gate 93, on the other hand, is similar to the "Developer Shut-Off Apparatus" described and claimed in a copending and commonly assigned U.S. patent application of Richard E. Smith, which was filed Apr. 29, 1974 under Ser. No. 464,862. That is, it includes an elongated premanent magnet 101 which is poled to attract the ferromagnetic carrier component of the developer and which extends across substantially the full width of the sump 56. Here, however, the magnet 101 is carried by a bracket 102 which, in turn, is secured to the shaft 94. Moreover, the strength of the magnet 101, the length of the bracket 102, and the angular orientation of the bracket 102 relative to the strapping link 96 are selected so that developer freely flows from the sump 56 when the thumb screw 97 is seated in the bore 98 (i.e., when the latching mechanism 83 is engaged), but not when the latching mechanism 83 is disengaged. Indeed, when the latching mechanism 83 is disengaged, the bias supplied by the spring 95 causes the magnet 101 to abut against the sump 56 at approximately the level of the discharge opening 61. Hence, the flow of developer from the sump 56 is then interrupted by the developer bridge that forms.

As will be appreciated, the development rolls 51–54 and the transport rolls 57 and 58 may be purged of developer simply by disengaging the latching mechanism 83 to close the flow gate 93 and thereafter operating the development system 11 for a short period of time sufficient to recirculate the developer that may already be on those rolls back to the sump 56.

CONCLUSION

In view of the foregoing, it will now be understood that the split housing of the present invention may be used to advantage with near and existing magnetic brush development systems. Specifically, such a housing permits the development system to be internally accessed for maintenance purposes and the like, without upsetting the critical development roll-to-photoconductor spacing or spacings. Also, it will be appreciated that there desirably is a flow gate interlocked with the latch for such a housing so that the flow of developer from the sump is automatically interrupted whenever the housing is split. Indeed, there advantageously is provision for operating the development system while the flow gate is closed so that the development roll or rolls and any transport rolls may be purged of developer simply by closing the flow gate and thereafter operating the development system for a short period of time.

While the invention has been described in connection with a magnetic brush development system, it will be apparent that certain of its features are of broader utility. In particular, the interlocked latching mechanism and flow gate are a worthwhile combination for any type of development system that is provided with a split housing, if there otherwise would be a risk of developer being spilled from the system sump when the housing is split.

What is claimed is:

1. A magnetic brush development system for developing latent electrostatic images carried by a substrate; said system having a split housing comprising a stationary section positioned adjacent said substrate and including at least one development roll spaced a predetermined distance from said substrate for brushing said substrate with developer;

a movable section located outboard of said stationary section, said movable section being mounted for movement relative to said stationary section and including a sump for storing a supply of developer, said sump having a discharge orifice means for moving said developer along a flow path from said sump, through said orifice to said roll and back to said sump;

a latching mechanism operative in a first position to secure said movable section to said stationary section and operative in a second position to release said movable section from said stationary section; and a flow gate coupled to said latching mechanism and movable in response to the movement of said mechanism for interrupting the flow of developer from said sump whenever said latching mechanism is in said second position and for permitting said flow when said mechanism is in said first position.

2. The development system of claim 1 wherein said developer includes a ferromagnetic component;

said movable section is secured to and released from said stationary section by engaging and disengaging, respectively, said latching mechanism; and said flow gate includes a magnet poled to attract the ferromagnetic component of the developer, and means for moving said magnet away from and toward said sump as said latching mechanism is engaged and disengaged, respectively; said magnet being displaced a sufficient distance from said sump when said latch is engaged to permit developer to freely flow from the sump, but said magnet having sufficient magnetic field strength to cause bridging of the developer within the sump when the magnet is moved there toward.

3. The development system of claim 1 wherein said latching mechanism and said flow gate are rigidly interconnected so that said flow gate is opened and closed as said movable section is secured to and released from, respectively, said stationary section.

4. The development system of claim 3 wherein said latching mechanism and said flow gate are secured to a rotatable shaft, and further including bias means coupled to said shaft for urging said shaft to rotate in a direction tending to close said flow gate.

5. The development system of claim 1 wherein said substrate and the stationary section of said housing define a development zone of predetermined length and width;

said developer comprises a ferromagnetic component; and said flow gate comprises an elongated permanent magnet poled to attract the ferromagnetic component of said developer, and means for moving said magnet away from and toward said sump to pass and interrupt the flow of developer through said discharge orifice as said movable section is secured to and released from, respectively, said stationary section.

6. The development system of claim 5 wherein the movable section of said housing is mounted for movement transversely of said development zone.

7. The development system of claim 6 wherein said flow gate and said latching mechanism are mounted for rotation with a shaft journalled in the movable section of said housing; said latching mechanism comprising a strapping link having one end connected to said shaft and its other end capable of being secured to the stationary section of said housing; said flow gate including a bracket having one end connected to said shaft and its other end secured to said magnet.

8. The development system of claim 7 further including bias means coupled to said shaft for urging said shaft to rotate said magnet into abutting relationship with said sump; said bracket having a length selected so that said magnet is held against said sump approximately level with said discharge opening when said movable section is released from said stationary section.

9. A development system for developing latent electrostatic images carried by a substrate as said substrate moves through a development zone; said system having a split housing comprising a stationary section positioned adjacent said substrate to define said development zone, said stationary section including means for contacting said substrate with developer;

a movable section located outboard of said stationary section, said movable section being mounted for movement relative to said stationary section and including a sump for storing a supply of developer, said sump having a discharge opening through which developer tends to flow toward said means for contacting;

means for moving developer along a path from said sump, through said discharge opening, through said development zone and back to said sump;

means for releasably securing said movable section to said stationary section; and means for automatically interrupting the flow of developer from said sump whenever said movable section is released from said stationary section.

10. The development system of claim 9 wherein said movable section is releasably secured to said stationary section by a latching mechanism which is engaged and disengaged to secure and release, respectively, said sections; and the flow of developer from said sump is subject to being interrupted by a flow gate which is interlocked with said latching mechanism to pass and interrupt said flow when said latching mechanism is engaged and disengaged, respectively.

11. The development system of claim 10 further including biasing means coupled to said flow gate for urging said flow gate into position to interrupt said flow whenever said latching mechanism is disengaged.

12. The development system of claim 10 wherein said developer includes a ferromagnetic component; and said flow gate comprises an elongated permanent magnet extending across said sump, and means for moving said magnet away from and toward said sump as said latching mechanism is engaged and disengaged, respectively; said magnet being poled to attract the ferromagnetic component of said developer and having a magnetic field strength selected so that the flow of developer from said sump is selectively interrupted and passed as said magnet is moved toward and away, respectively, from the sump.

* * * * *